US008701914B1

(12) United States Patent
Buck

(10) Patent No.: US 8,701,914 B1
(45) Date of Patent: Apr. 22, 2014

(54) TWO-PART RECYCLABLE CUP

(71) Applicant: Ronald Mark Buck, Encinitas, CA (US)

(72) Inventor: Ronald Mark Buck, Encinitas, CA (US)

( * ) Notice: Subject to any disclaimer, the term of this patent is extended or adjusted under 35 U.S.C. 154(b) by 0 days.

(21) Appl. No.: 13/767,883

(22) Filed: Feb. 15, 2013

(51) Int. Cl.
*B65D 3/22* (2006.01)

(52) U.S. Cl.
USPC ..... 220/23.87; 229/403

(58) Field of Classification Search
USPC ..... 220/739, 738, 737; 229/404, 403, 400
See application file for complete search history.

(56) References Cited

U.S. PATENT DOCUMENTS

| | | | | |
|---|---|---|---|---|
| RE25,618 | E | 7/1964 | Goodman | |
| 3,456,860 | A | 7/1969 | Janninck | |
| 3,580,468 | A | 5/1971 | McDevitt | |
| 3,910,414 | A * | 10/1975 | McCay | 206/515 |
| 4,872,569 | A | 10/1989 | Bolte | |
| 5,524,817 | A | 6/1996 | Meier et al. | |
| 6,109,518 | A * | 8/2000 | Mueller et al. | 229/403 |
| 6,652,435 | B1 * | 11/2003 | Sand | 493/84 |
| 7,699,216 | B2 * | 4/2010 | Smith et al. | 229/403 |
| 2002/0125262 | A1 * | 9/2002 | Canfield | 220/739 |
| 2005/0103794 | A1 * | 5/2005 | Liu | 220/703 |
| 2006/0091143 | A1 * | 5/2006 | Chantalat | 220/737 |
| 2010/0038273 | A1 * | 2/2010 | Johnson | 206/459.5 |
| 2010/0108703 | A1 * | 5/2010 | French | 220/737 |
| 2010/0187247 | A1 * | 7/2010 | Ziegler | 220/783 |
| 2010/0320213 | A1 * | 12/2010 | Kelly et al. | 220/592.2 |
| 2012/0165170 | A1 | 6/2012 | Wischusen, III | |

* cited by examiner

*Primary Examiner* — Steven A. Reynolds
*Assistant Examiner* — King M Chu
(74) *Attorney, Agent, or Firm* — ARC IP Law, PC; Joseph J. Mayo

(57) ABSTRACT

A paper cup or shell with a thin removable liner that is not laminated to the cup or shell such that the liner may be easily disengaged, removed, or separated from the cup or shell prior to disposal or the recycling process. The thin removable or detachable liner is preferably made from aluminum, aluminum alloy, or aluminum foil, as opposed to other recyclable materials. Aluminum is the preferred material for the liner due to the fact that aluminum is infinitely recyclable and can be used over and over again to make recycled aluminum products or recycled detachable cup liners.

20 Claims, 12 Drawing Sheets

TWO-PART RECYCLABLE CUP

BACKGROUND OF THE INVENTION

1. Field of the Invention

One or more embodiments of the invention are related to the field of recyclable cups. More particularly, but not by way of limitation, one or more embodiments of the invention enable a two-part recyclable cup having an outer recyclable shell and recyclable liner.

2. Description of the Related Art

Recycling statistics state that 200 billion disposable paper cups and approximately 50 billion plastic cups are used annually in the United States (2012). Globally, the number is higher. Approximately 315 million people live in the U.S. (2012), which means that the average American uses two disposable cups per day, or approximately 730 per year.

Research statistics state that globally the disposable market is growing at a rate of 5.4% annually. If trends continue in ten years, the global consumption of disposable paper cups will increase by 50%, to 375 billion cups used annually in 2023.

To keep waste out of landfills for future generations, the need for recyclable cups is evident. However, the development of a completely recyclable cup has been elusive. Disposable paper coffee cups or hot drink cups comprise a laminated plastic film on the interior wall of the cup. The plastic film, which is adhered to a paper sheet prior to the construction of the cup, is very thin and transparent, such that the average consumer is unaware that the plastic film exists.

However, recycling companies that can potentially recycle the cups are more than aware of the interior wall-laminated plastic film. Separating the thin laminated film from the interior wall of the paper cup so that these components can be separated and recycled is a difficult, inefficient, cost-prohibitive, waste-producing process. Clearly, other options for developing recyclable cups must be considered.

There are several inventions in the field of the art that refer to multiple-part cup configurations. The majority of these inventions relate to insulated cups, but do not specifically refer to recyclable cups with a removable aluminum liner. An example of a two-piece insulated cup is U.S. Patent Publication Serial No. 2010/0264201, to Smith. Although this publication addresses an outsert and insert, the insert is attached to the outsert at the rim of the embodiments. Additionally, the patent by Smith does not address the issue of recyclability, as the preferred material of choice for the insert is foam or plastic when aluminum is a superior selection for recycling considerations. Smith '201 mentions thermoforming as a preferred method for manufacturing the insert, while an aluminum liner or insert is preferably formed in a similar fashion to an aluminum can, which is called a deep-drawn and ironing process. Smith '201 has no hole in the bottom of the outsert to facilitate removal of the liner, as the insert is not designed to be removable, which means the insert cannot be easily separated from the outsert prior to disposal or recycling. Smith '201 mentions vertical indentations as standoff elements incorporated into the sidewalls of the insert, but however does not contemplate vertical standoff elements incorporated into the sidewall of the shell.

In addition to hot-drink paper cups, cold-drink plastic cups also have recycling-related problems. Because plastic cups can be made from various types of plastic, identifying and separating these various plastics as they travel rapidly through conveyor systems requires expensive complex machinery. Some recycling plants have this capability, while others do not. Additionally, the lightweight nature of plastic cups makes them difficult to convey through automated systems of the recycling plant. Lightweight plastic cups can bounce off, roll off, or blow off rapid conveyor-belt machinery.

For at least the limitations described above there is a need for a two-part recyclable cup.

BRIEF SUMMARY OF THE INVENTION

One or more embodiments described in the specification are related to an unlined paper cup or shell with a thin removable interior liner that is not laminated to the cup or shell such that the liner may be easily disengaged, removed, or separated from the cup or shell prior to disposal or recycling.

The thin removable or detachable liner is made from aluminum, aluminum alloy, or aluminum foil, as opposed to other recyclable materials. Aluminum is the preferred material for the liner due to the fact that aluminum is infinitely recyclable and can be used over and over again to make recycled aluminum products or recycled detachable cup liners.

Aluminum is the most abundant metal on Earth. The success of aluminum-can recycling points to advantages of a detachable aluminum cup liner. Currently, 50% of all aluminum cans produced are made from recycled aluminum. A can be recycled and back on the store shelf in 60 days. Every minute of every day, 100,000 aluminum cans are recycled.

For example, the thin aluminum cup liner construction may resemble the deep-drawn primary body of an aluminum can without the secondary top piece of the can. However, the sidewalls of the topless can would flare or taper outward toward the top opening of the removable aluminum liner. The removable liner may be manufactured on modified existing automated can-manufacturing machinery. For example, the primary can body without the top cap piece may be formed with thin walls during the drawing and ironing process, then the primary can body may be reshaped in an additional process that forms the tapered walls and any other design elements that may be important to the function of the aluminum can liner. The aluminum liner may be painted, printed, or coated on the interior or exterior of the liner.

The typical wall thickness of an aluminum can is approximately 0.17 mm, which would be appropriate for the cup liner; however, it may be thicker or thinner as well. For structural stability or to provide an insulative air pocket gap, the bottom horizontal wall of the liner, for example, may have an upward indentation similar to a can. The top edge of the aluminum liner may be rolled back to the exterior side of the liner to create a round top edge that provides a coupling mechanism for a cup lid. A top food container with any type of lid such as an attached claim shell style lid, seal-on/peel-off lid, or non-attached press-on lid may couple to the lid that couples to the rolled edge of the liner. The lid that couples to the rim of the aluminum liner may also embody a downward cavity of any size or shape that acts as a food or liquid container for items such as a cookie for example. Additionally, there may be a lid of any type such as a seal-on/peel-off lid, or press-on lid that covers the food or liquid cavity in the lid that couples to the rim of the aluminum liner.

The top rolled edge of the liner provides stability and structural strength for the top edge and sidewalls of the thin aluminum liner. In addition to a rolled-back top edge, a separate top edge of a similar shape to the rolled edge may be attached as part of a two-piece construction. The aluminum liner may be manufactured in a two-part construction that includes a main body with tapered walls that includes a vertical seam that joins the walls of the liner, and a bottom piece that is attached through an additional process. The sidewalls of the aluminum liner may have inward or outward vertical or horizontal-oriented strength ribs or horizontal collapsible indentations or standoff elements of any shape. Additionally, the inward or outward, vertical or horizontal-oriented strength ribs or collapsible indentations may serve the dual function of acting as standoff elements to provide insulative air-pocket gaps that are formed between the liner and shell that allow the outer shell or cup to remain cool to the touch of the hand while hot liquids are retained within the aluminum liner. The air-gap or standoff elements that may be integrated into the tapered or substantially vertical walls of the liner, may be independently designed elements that are not correlated with the strength ribs or collapsible indentations. The aluminum liner may have smooth tapered walls with no indentations or ribs. Additionally, there may no air-gap elements such that the tapered walls of the liner touch the tapered walls of the shell. In this configuration, a thermal protective layer or layers that provides a cool surface for the user's hand may be applied to the exterior of the shell. The thermal protective layer or layers may or may not include adhesives or laminations. If the aluminum liner has smooth walls and is designed to be part of a cold drink cup, there is no need for a thermal protective layer or layers. After being used and removed from the shell, the aluminum cup liner can be turned upside down, placed on the ground, and stomped until flat.

The exterior shell of the two-part recyclable cup may for example be manufactured on existing automated paper-cup machinery. However, an important component of typical paper-cup construction will be left out, i.e., the thin film interior wall plastic laminate. Without the plastic liner, the cup is easily recyclable.

Additionally, the exterior paper cup or shell of the two-part construction may be made from recycled paper or pulp. The lid of the two-part recyclable cup preferably attaches to the rolled or attached rim of the aluminum liner; therefore, the top edge of the exterior paper or pulp cup or shell does not require a rolled edge. The top edge of the exterior paper or pulp shell may remain flat, raw, or unfinished.

Another component of the exterior recyclable paper cup that may be omitted while being produced on existing automated paper-cup manufacturing machinery is the bottom of the cup. Because the aluminum cup liner is leak-proof, it is not necessary for the exterior paper shell to have a bottom. However, for example, a bottom is preferred, as it adds structural stability to the overall embodiment of the invention. A hole, for example large enough for a fingertip to pass through, or approximately 1" may be die-cut through the bottom of the exterior paper shell to provide a means of popping out the interior aluminum liner with an upward push of a fingertip through the hole. Any other size hole that enables the two components to be disengaged is in keeping with the spirit of the invention. The hole in the bottom of the paper or pulp shell may also act as a pressure release opening that allows air to escape when the shell is turned upside down, placed on the ground, and stomped with a foot to create a compact and easy-to-transport recyclable disk-shaped unit. The hole in the bottom of the shell additionally acts as a vacuum pressure release opening that prevents air pressure or suction from forming while inserting or lifting the liner into or from the shell during the process of installation or removal.

Additionally, an upward dome-shaped indentation for receiving the end of a finger may be configured or pressed into the bottom of the thin aluminum liner. When a finger is placed through the hole in the bottom of the outer paper or pulp shell, the fingertip may leverage against the dome-shaped receptacle while pushing upward. The outside diameter edge of the upward dome-shaped indentation may project downward through the pre-cut hole in the shell to engage the two components. The liner and outer shell may also be pulled apart by gripping with thumb and forefinger the rolled aluminum rim of the liner. If the outer paper shell has a rolled or round rim or no rim, a gap may between the rolled rims or rim, so that the liner is easy to grip and remove. Alternatively, embodiments may not implement a gap between rims. The height of the sidewalls of the liner in relation to the shell determines the space or gap left between the top rolled edges or rolled and flat edge of the liner and shell. Once the liner has been placed within the shell and the bottom of the liner touches the bottom of the shell, then the height of sidewalls determines the gap between the top rolled edges or rolled and flat edge of the two parts. The rolled rim of the paper shell is not necessary for attaching or coupling a top lid. Although it is not preferred, it is keeping within the spirit of the embodiments set forth herewith for a lid to attach to the rim of a paper or pulp shell.

The exterior paper shell of the two-part construction of the recyclable cup may be made from preformed paper pulp, e.g., may be recycled or partially recycled pulp, or the pulp may be spray-coated on to the exterior of the aluminum liner. The top rolled edge of the liner would not be sprayed during a paper pulp coating process. Although it is not a preferred embodiment, the aluminum liner may have no rolled top edge and the sharp edge of the liner may become embedded in the tapered wall of the sprayed pulp shell. Additionally, it is not necessary to spray pulp on the bottom of the liner; however, pulp in this location may be preferable. The sprayed pulp shell will separate from the aluminum liner during the recycling process when water comes into contact with the shell.

The exterior paper (recycled content or not) shell serves several functions relating to the overall construction of the invention. First, the exterior paper (may be recycled or biodegradable plastic or any other appropriate material as well) shell provides stability or structure for the thin and/or flimsy interior aluminum liner. Second, the paper shell provides thermal insulation for hot and cold drinks to keep them hot or cold for an extended period of time. Third, the exterior paper shell provides a protective barrier to reduce heat transfer from the aluminum liner to the user's hand. Because aluminum absorbs heat and is thermally conductive, the exterior paper shell may be made in any thickness or may be constructed utilizing multiple walls, layers, materials, or adhesive-based laminations. The exterior paper shell may incorporate a exteriorly or interiorly located corrugated or insulative layer and/or smooth exterior printable layer or surface. The aluminum liner may have at least one vertical or horizontal-oriented ridges (or any other shape) or standoff elements that project outward from the sidewall of the liner that creates air gaps between the liner and outer shell such that the outer shell is not hot while being gripped or touched by the user.

At least one embodiment for the outwardly projecting air-gap or standoff elements is a horizontal band near the top edge of the liner that contacts the interior wall of the shell that is perpendicularly intersected by long, narrow vertically oriented ribs that run the length of the liner and proceed to the bottom edge of the embodiment. The outwardly projecting band at the top portion of the liner serves the important function of providing a stopping point for the vertical oriented standoff elements before they reach the top edge of the liner. If the standoff elements did proceed to the top edge, it would not be possible to roll the top edge of the liner. The top band serves three functions overall. First, it provides a wide surface area where the interior wall of the shell and exterior wall of the liner are in direct contact, which facilitates surface tension for coupling or seating the liner within the shell. Second, it brings the fluid that is held within the liner closer to the adjacent sidewall of the exterior shell. Additionally, this means that the rolled edge of the liner extends further outward from the exterior sidewall of the shell so a low interference rolled coupling rim is provided for the top lid that couples to the liner. Third, the band provides an intersection point for the vertically oriented standoff elements so the top edge of the liner remains indent free, and may be rolled to provide a coupling mechanism for a lid.

Although not shown for brevity, there may be optional small or short, vertically oriented hot air release air vent channels that intersect the top horizontal outwardly protruding band of the liner at the midpoint, for example, between the standoff elements, or vertical ridges that allow hot air to be released or escape from the air pocket gaps that are formed between the shell and aluminum liner. The small or short hot air release channels may be implemented to stop before reaching the top edge of the horizontal band of the liner so the top edge may be rolled to the exterior of the embodiment without being interrupted by indentations.

Conversely, due to the fact that when pulp is formed into a structure, it is possible to form multiple wall thicknesses, this means the vertically oriented air gap or standoff ridges may be integrated into the interior wall of the pulp shell. If the standoff ridges are formed or integrated into the interior wall of the pulp shell, then there is no horizontal band near the top of the liner and the aluminum liner has smooth sidewalls with no indentations, elements or ribs.

The interior aluminum liner press-fits down into the exterior paper or pulp shell to form an embodiment of the invention. The liner may be preassembled and press-fit into the exterior paper or pulp shell prior to distribution, or the two components may be shipped as separate pieces and assembled at a desired location. When the interior aluminum liner is press-fit into the outer paper shell, the two parts mate together utilizing wall-to-wall surface tension or friction. Additionally, there may be any type of male and/or female indentations in the tapered or substantially vertical walls or bottom wall of the two parts that facilitate coupling or mating of the parts. If wall heights are equal, there may be releasable coupling at the top lip area of the two components.

When the liner or shell is packaged for transport as a separate component, the part is stacked within itself for space conservation during shipping. Additionally, space conservation is important in retail environments where space is limited. To prevent stacked parts from becoming stuck together, any shape male and/or female indent may be incorporated into the tapered or substantially vertical sidewall or horizontal bottom wall of either part. If the liner and shell are preassembled and press-fit together prior to transport, the liner may incorporate any size or shape indent in the tapered or substantially vertical wall or horizontal bottom wall that prevents the assembled parts from sticking together while stacked for transport.

Although the rolled rim of the aluminum liner may become hot when the embodiment is used for hot drinks such as coffee, the rim does not come into contact with the user's lips due to the implementation of a plastic lid. The plastic lid may be made from recycled or compostable plastic or other materials. Most plastic coffee-cup lids, for example, have upward vertical sidewalls that create distance between the hot aluminum rim and the user's mouth.

The embodiment of the invention may be made from recycled or partially recycled materials and may comprise two or more main body components consisting of a thin aluminum liner with a rolled or round top edge and an outer paper or pulp shell that may comprise additional thermal protective constructions. The aluminum liner utilizes friction to press-fit into the outer paper or pulp shell. Air gaps that keep the outer surface of the shell cool may be provided through the implementation of an outward horizontal band and outward vertical ridges or standoff elements in the aluminum liner, or conversely inward vertical ridges or standoff elements may be integrated into the interior wall of a pulp shell.

The two main components of the embodiment may be easily disengaged or separated prior to recycling. The outer shell may have a hole through the bottom for a fingertip to push up and pop out the interior aluminum liner. Additionally, a gap may be provided between the top edges of the liner and shell so the rim of the liner is easy to grip and remove from the liner. Once the aluminum liner is separated from the outer shell, both parts may be recycled and transformed into additional paper and aluminum products. The creation of a completely recyclable cup and liner that may be made from completely recycled or partially recycled materials means that each year billions of paper and plastic cups may be kept out of landfills, which is good for the environment and future generations.

Embodiments of the invention may be utilized with any of the lids, or a separate top container that couples to a lid with an attached claim-shell style lid, seal-on/peel-off lid, or non-attached press-on lid, or lid containers that couple to the rim of the aluminum liner and include a downward projecting cavity for food or liquid that additionally may include a secondary seal-on/peel-off lid or press-on lid described herein or as disclosed in Applicant's co-pending patent applications including U.S. Utility patent application Ser. No. 13/733,153, filed 3 Jan. 2013, U.S. Utility patent application Ser. No. 13/680,049, filed 17 Nov. 2012, U.S. Utility patent application Ser. No. 13/680,011, filed 17 Nov. 2012, U.S. Utility patent application Ser. No. 13/605,967, filed 6 Sep. 2012, U.S. Utility patent application Ser. No. 13/360,707, filed 28 Jan. 2012, and U.S. Utility patent application Ser. No. 13/226,346, filed 6 Sep. 2011, the specifications of which are hereby incorporated by referenced herein.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

A two-part recyclable cup will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
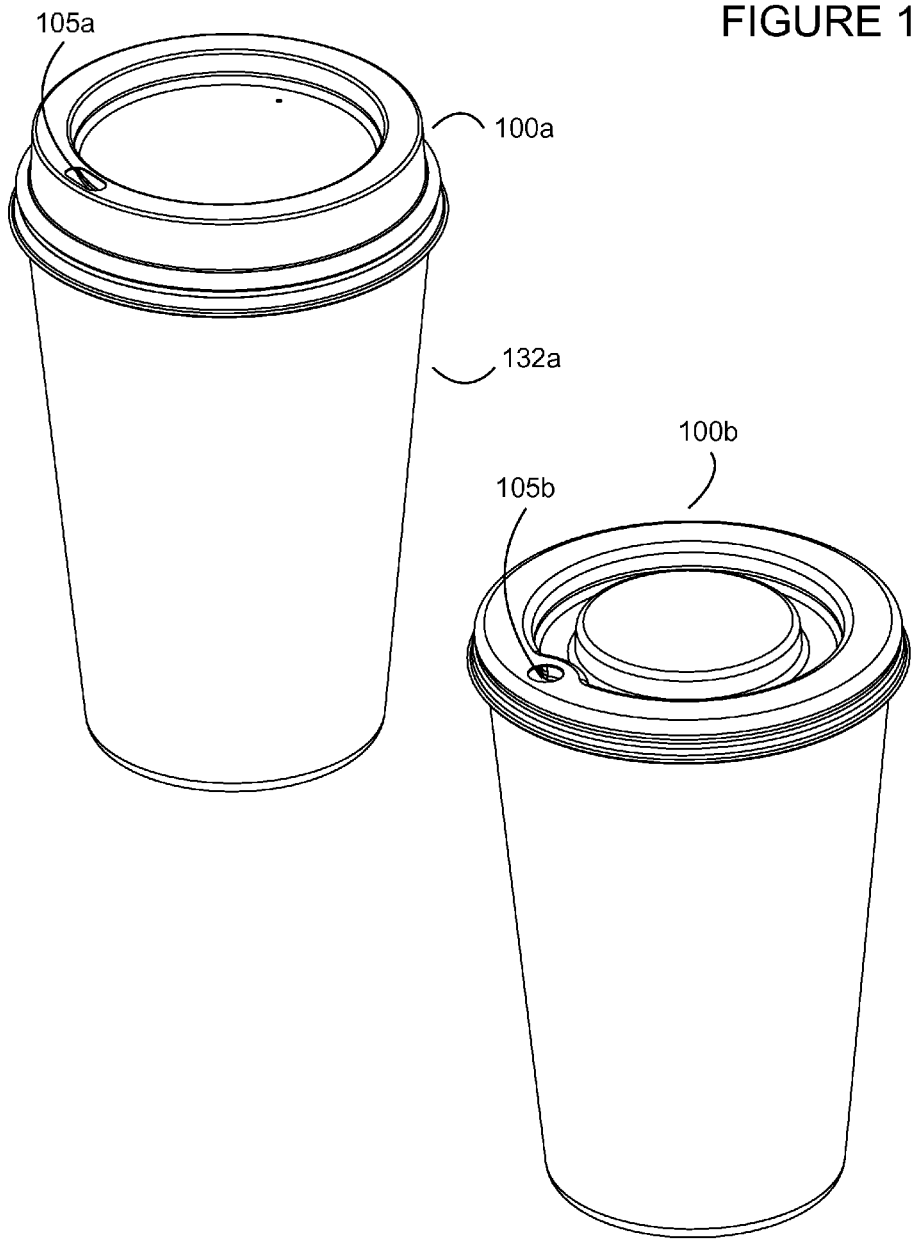
FIG. 1 illustrates a perspective view of an embodiment of the two-part recyclable cup having an outer pulp shell with different lids.

FIG. 1 illustrates a perspective view of an embodiment of the two-part recyclable cup having an outer pulp shell with different lids. The first lid 100*a* shown in the upper left of the figure includes sip hole 105*a* and the second lid 100*b* shown in the lower right of the figure includes straw hole 105*b*. One or more embodiments include a pulp outer shell 132*a* that surrounds an inner liner, for example made of aluminum.

Figure 2:
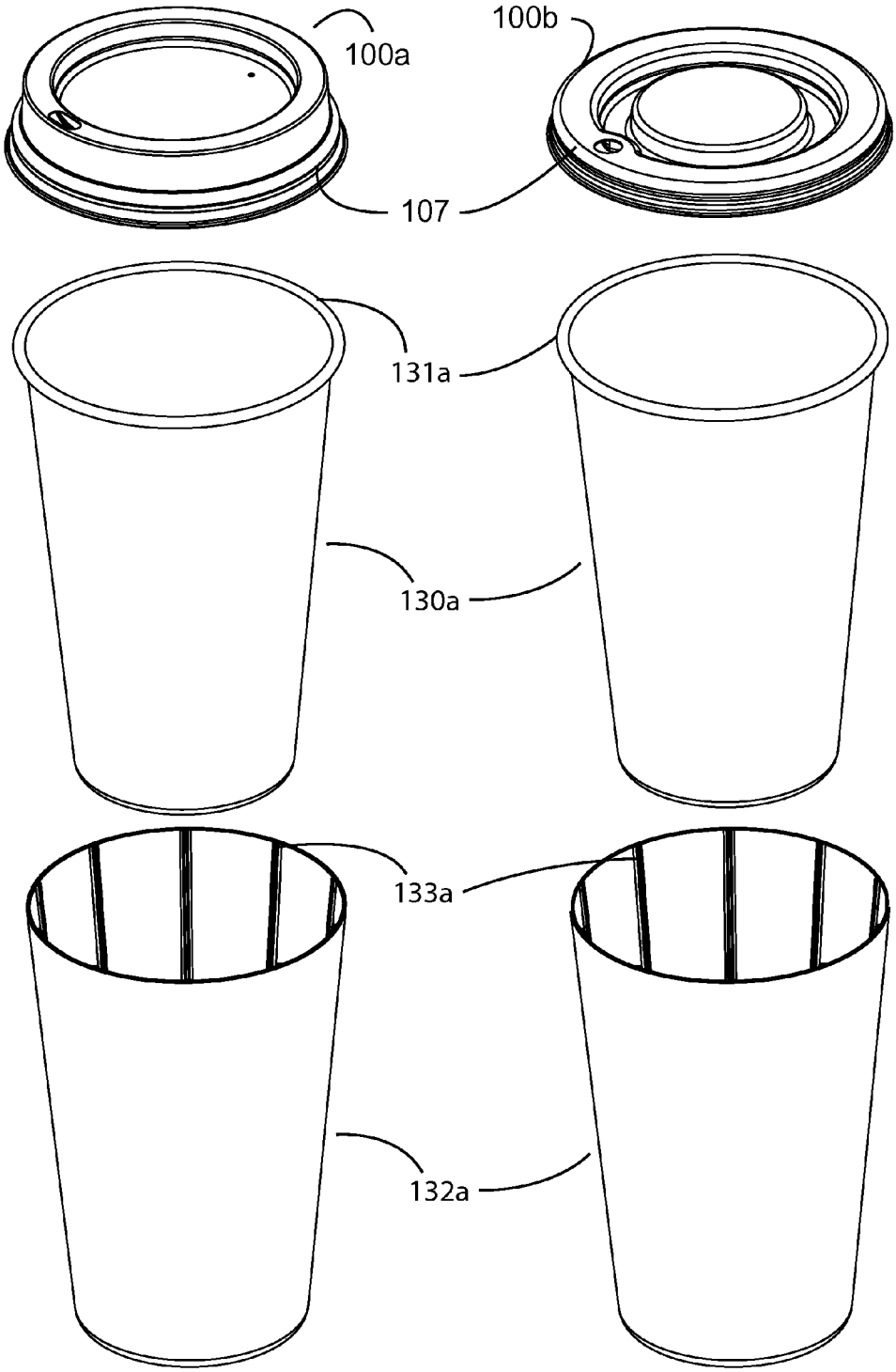
FIG. 2 illustrates an exploded view of an embodiment of the two-part recyclable cup having an outer pulp shell and aluminum liner with different lids.

FIG. 2 illustrates an exploded view of an embodiment of the two-part recyclable cup having an outer pulp shell 132*a* and aluminum liner 130*a* with different lids. Each of the lids may include coupling element 107 that is configured to non-permanently couple the lid or lid container to lip 131*a*. A separate solid or liquid top container with any type of lid such as an attached clamshell lid, seal-on/peel-off lid, or non-attached press-on lid may couple to the top of either lid 100*a* or 100*b*. The lid that couples to the rim of the aluminum liner may also embody a downward cavity of any size or shape that acts as a food or liquid container for items such as a cookie for example. Additionally, there may be a lid of any type such as a seal-on/peel-off lid, or press-on lid that covers the food or liquid cavity in the lid that couples to the rim of the aluminum liner. In one or more embodiments, the thin removable aluminum liner 130*a* includes lip 131*a*. The liner is made from aluminum, aluminum alloy or aluminum foil. The liner may be coated with any type of coating on the interior or exterior. The liner is configured to fit within the pulp shell. In other embodiments, the liner is configured to fit into an outer paper shell or cup as is shown in FIGS. 7-12. In one or more embodiments, the paper or pulp outer shell is configured without interior-laminated films or liners, which makes the shell easy to recycle. In one or more embodiments, the thin removable aluminum liner 130*a* has an integrated exteriorly located rolled top edge, formed top edge, folded top edge, or applied top edge, otherwise designated herein as lip 131*a*, which is configured to provide coupling as well as structural stability. In addition, the thin removable aluminum liner or the paper or pulp outer shell may include a coupling element, for example the lip or any other element that is configured to enable a lid to couple to the top edge of the thin removable aluminum liner or the paper or pulp outer shell. In one or more embodiments, the thin removable aluminum liner includes a tapered wall that flares outward toward the top opening of the liner, which is shown as a wider mouth area near the top than at the bottom for example. This enables embodiments of the thin removable aluminum liner and the paper or pulp outer shell to stack within themselves or each other to conserve space during shipping or retail applications. Due to the fact that when pulp is formed into a structure, it is possible to form multiple wall thicknesses; this means vertically oriented air gap or standoff ridges 133*a* may be integrated into the interior wall of the pulp shell. The standoff elements 133*a* prevent the majority of the interior tapered wall surface of the shell from contacting the exterior tapered wall of the liner. The standoff elements 133*a* form insulative air pockets between the shell and liner that help keep liquids hot. Additionally, the air pocket gaps that are provided by standoff elements 133*a* prevent the outer shell from getting hot in relation to the user's hand. Standoff elements 133*a* are additionally referenced in FIG. 4.

Figure 3:
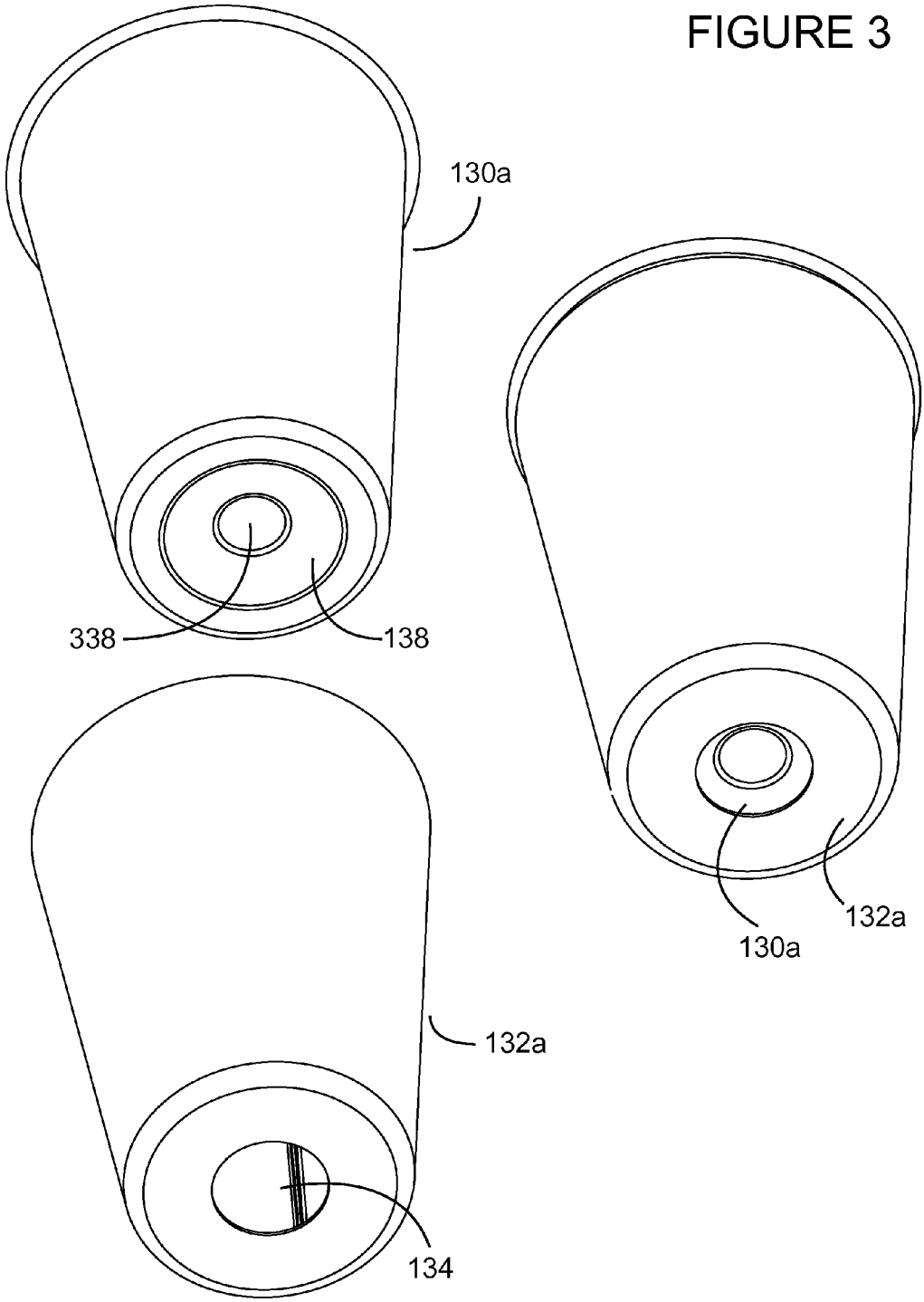
FIG. 3 illustrates a lower perspective view of an embodiment of the two-part recyclable cup having an outer pulp shell with a hole through the bottom separate and coupled with an aluminum liner.

FIG. 3 illustrates a lower perspective view of an embodiment of the two-part recyclable cup having an outer pulp shell with a hole through the bottom separate and coupled with aluminum liner 130*a*. Embodiments of the paper or pulp outer shell may include hole 134 through the bottom horizontal wall that is configured to enable a user to pop out the thin removable aluminum liner with an upward push of a fingertip through the hole. Additionally, the hole is configured to act as a pressure release opening that alleviates pressure or suction while engaging or disengaging the liner from the paper or pulp shell. In one or more embodiments, the thin removable aluminum liner is painted, coated, or printed on an interior or exterior. In one or more embodiments, the thin removable aluminum liner includes an upward-oriented dome-shaped indentation 138 in a bottom horizontal wall for structural stability, and optionally comprises an additional or independent upward dome-shaped indentation 338 in a bottom portion that acts as a receptacle for the fingertip to push upward while popping out the thin removable aluminum liner from the shell, for example. The outside diameter edge of the upward dome-shaped indentation 338 if utilized independently from element 138 may project downward through the pre-cut hole 134 in the shell to engage the two components.

Figure 4:
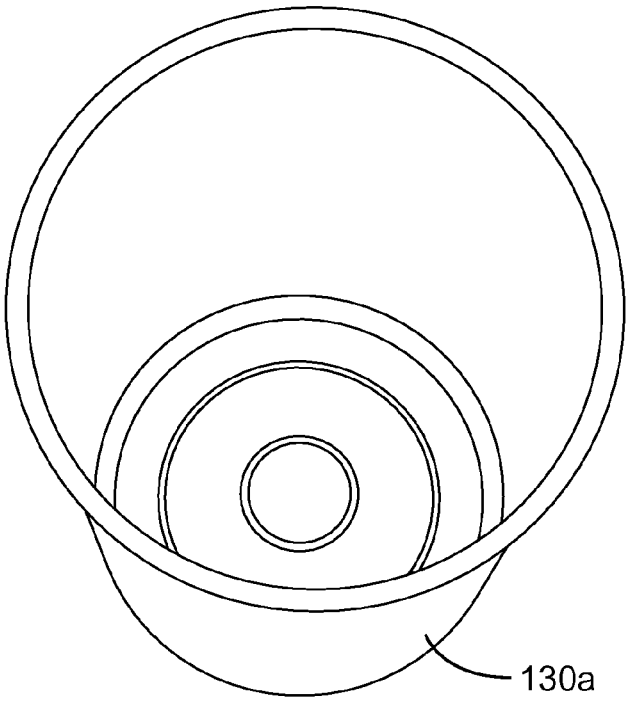
FIG. 4 illustrates an upper perspective view of an embodiment of the two-part recyclable cup with an aluminum liner on the top of the page and a pulp shell on the bottom of the page.
Figure 4:
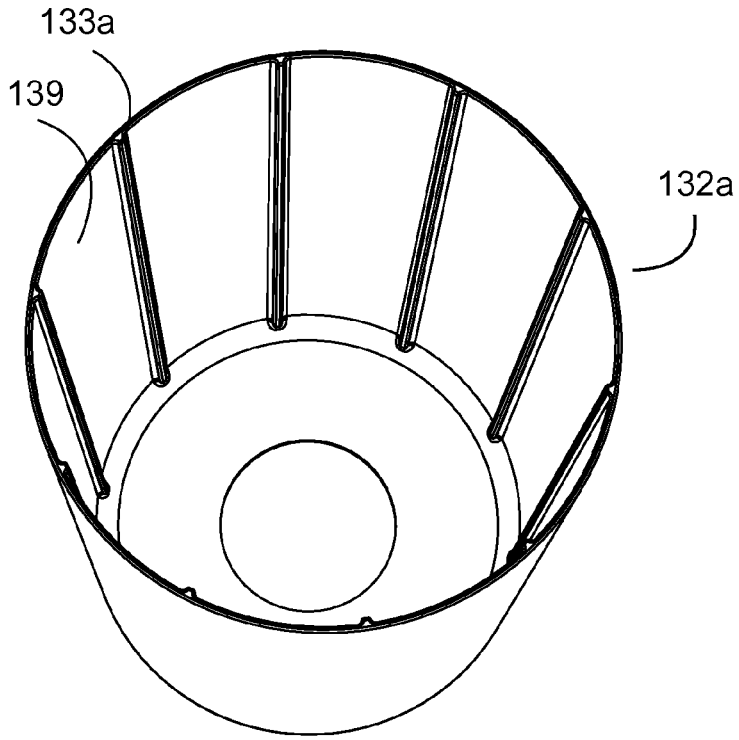

FIG. 4 illustrates an upper perspective view of an embodiment of the two-part recyclable cup with an aluminum liner on the top of the page and a pulp shell on the bottom of the page. The pulp shell 132*a* may be formed from recycled or partially recycled pulp. The pulp shell, hence, is recyclable due to the fact that foods or beverages do not come into contact with the shell. The shell remains clean and uncontaminated by residue. As shown on the lower half of the page of FIG. 4, the pulp shell 132*a* does not require a round or rolled top edge. The top edge of the pulp shell may remain flat, straight, raw, or unfinished. The outer paper or pulp shell 132*a* provides stability or structure for the thin and/or flimsy interior aluminum liner. If the standoff ridges 133*a* are formed or integrated into the interior wall of the pulp shell, there is no need for a top band or vertical ridges in the aluminum liner.

The tapered walls of the liner are smooth with no indentations or additional elements. The aluminum liner 130*a* press fits into the outer paper or pulp shell using surface-to-surface tension or friction. Air gap pockets 139 are formed between standoff ridges 133*a*.

Figure 5:
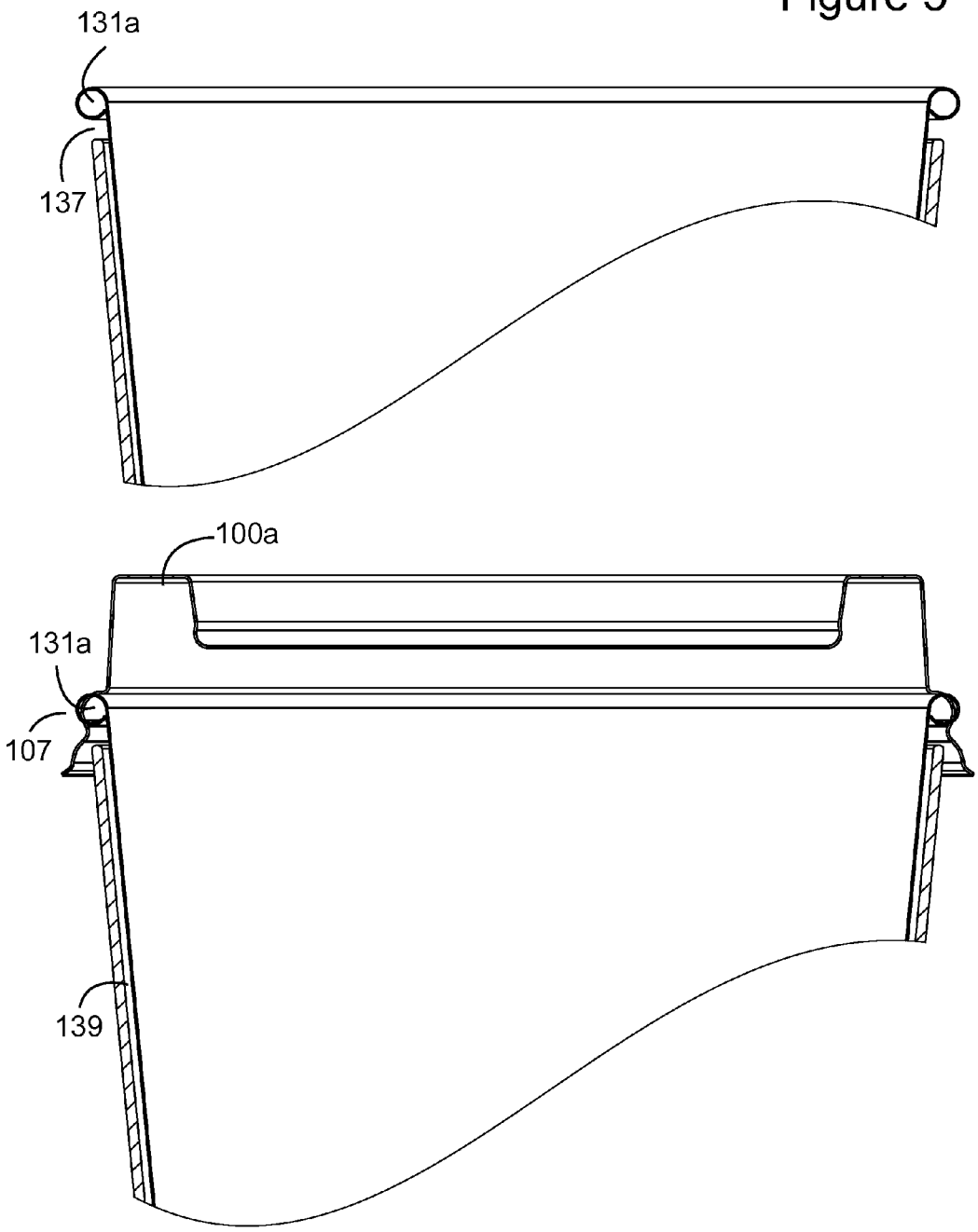
FIG. 5 illustrates a side cutaway view of an embodiment of the two-part recyclable cup having an outer pulp shell and aluminum liner without a lid coupled therewith.

FIG. 5 illustrates a side cutaway view of an embodiment of the two-part recyclable cup having an outer pulp shell and aluminum liner with and without a lid coupled therewith. Shown on the lower half of the page is lid 100*a* attached to lip 131*a* via coupling element 107. Embodiments of the lid may be configured to couple with the two-part recyclable cup wherein the lid is configured to couple to the rolled top edge 131*a* of the thin removable aluminum liner. In one or more embodiments there is a gap 137 that is formed between the top of the shell and liner that enables easy decoupling of the liner from the shell. The gap or space may for example be located between the exteriorly located rolled top edge of the thin removable aluminum liner and top edge of the paper or pulp outer shell which is provided to grip and remove the liner and wherein the gap or space is determined by the height of the sidewalls of the thin removable aluminum liner. Embodiments of the lid may include a food or liquid container and additional seal-on/peel-off lid or press-on lid or cover of any type for example shown as a downward indentation in the middle portion of the lid that couples to the rim of the aluminum liner, or the top food container may be a separate attachable container with an attached clamshell style lid, seal-on/peel-off lid, or non-attached press-on lid, as described in any of the patent applications incorporated herein by reference. The air-gap space 139 that is formed between the shell and liner that is provided by standoff elements 133*a* is shown on the lower half of the page of FIG. 5.

Figure 6:
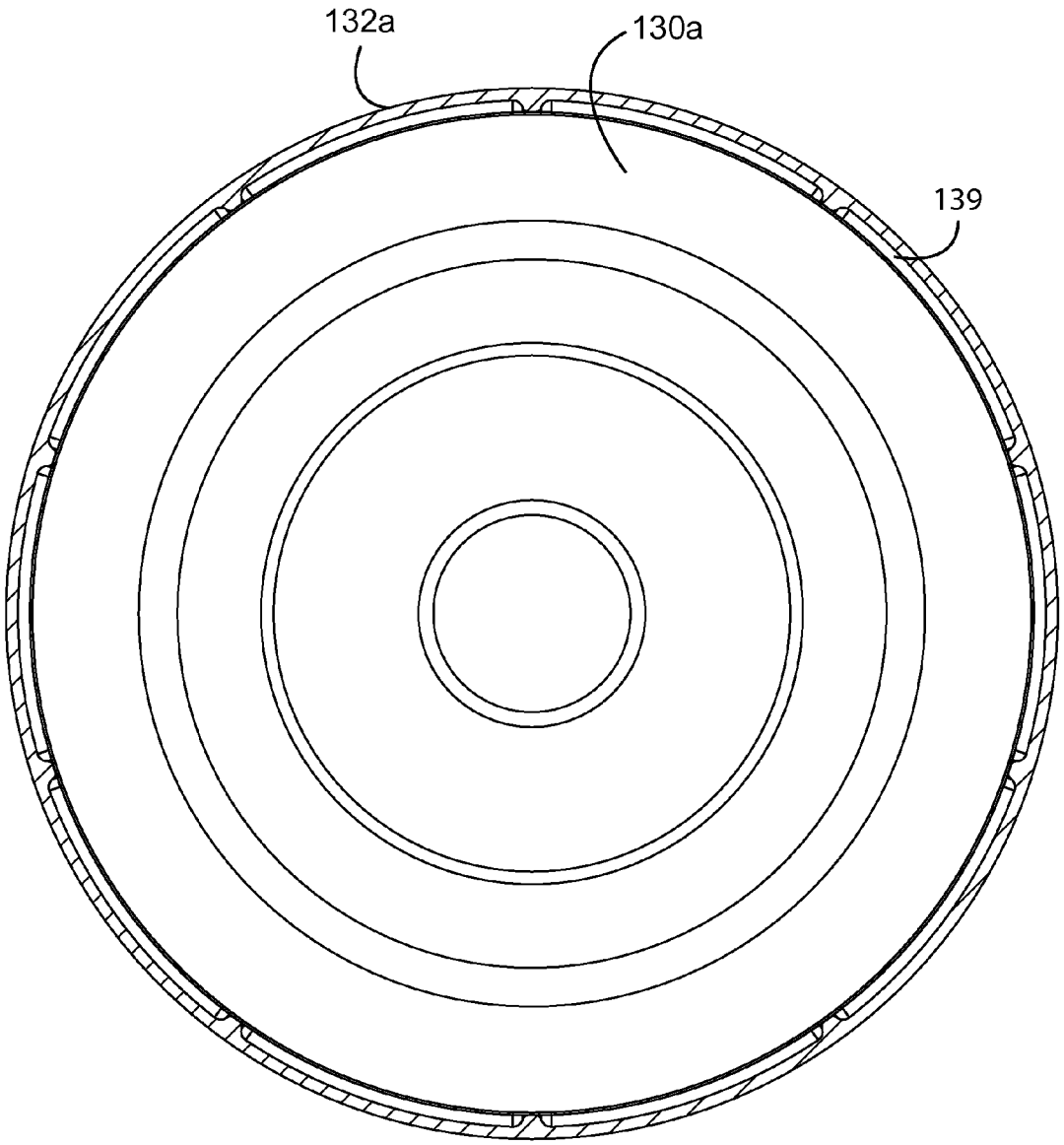
FIG. 6 illustrates a top cutaway view of an embodiment of the two-part recyclable cup having an outer pulp shell and aluminum liner.

FIG. 6 illustrates a top cutaway view of an embodiment of the two-part recyclable cup having an outer pulp shell and aluminum liner. Air-gap spaces 139 that are formed between the shell and liner are shown at various peripheral locations surrounding the embodiment.

Figure 7:
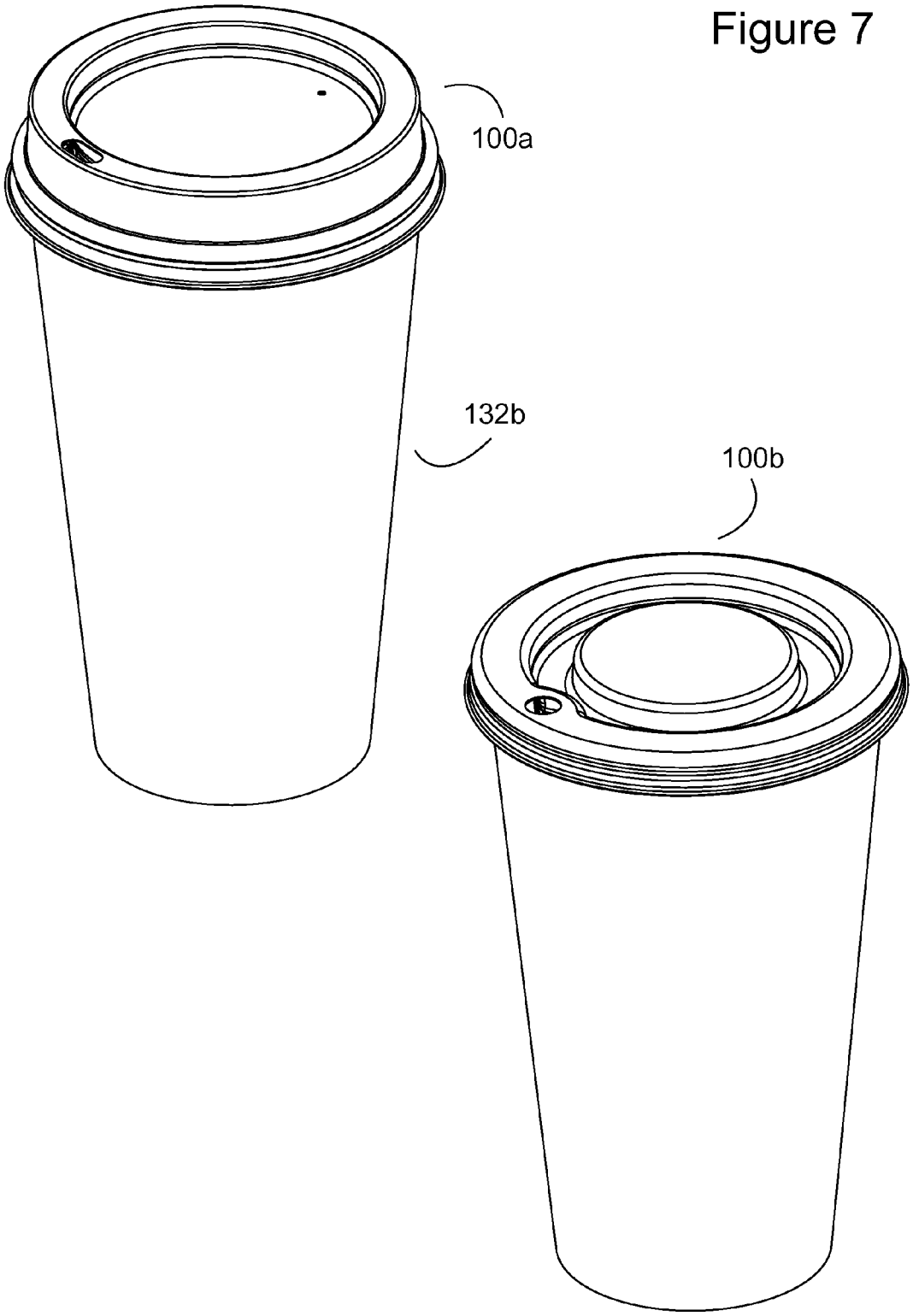
FIG. 7 illustrates a perspective view of an embodiment of the two-part recyclable cup having an outer paper shell or cup with different lids.

FIG. 7 illustrates a perspective view of an embodiment of the two-part recyclable cup having an outer paper shell or cup 132*b* with different lids, e.g., 100*a* and 100*b* that are intended to be a non-inclusive list of lids or lid containers that embodiments of the invention may utilize. The outer paper shell or cup that is shown as 132 may appear as a standard paper cup and may be made on existing automated cup manufacturing machinery except for the fact that the laminated plastic liner would be omitted from the production process.

Figure 8:
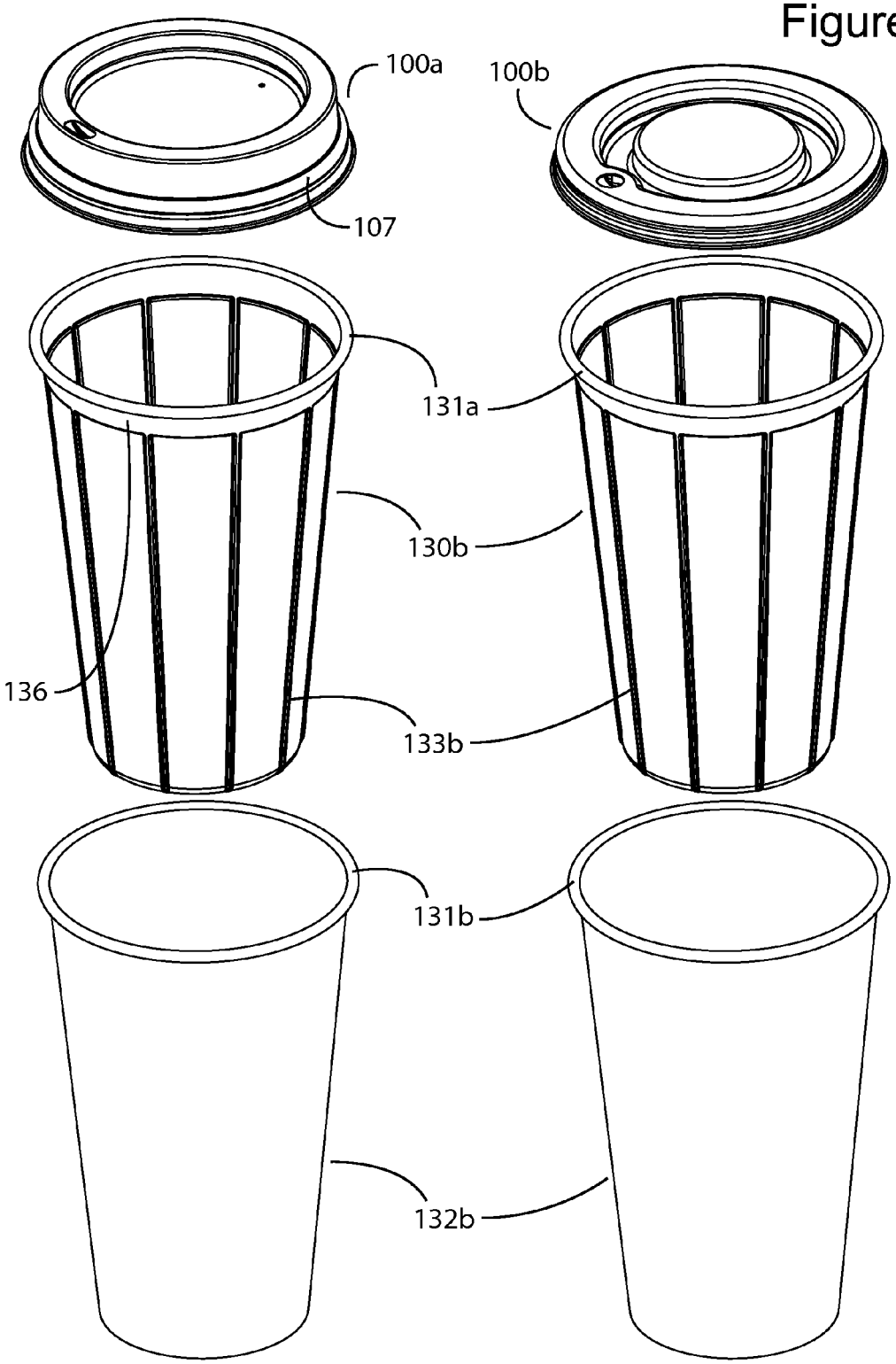
FIG. 8 illustrates an exploded view of an embodiment of the two-part recyclable cup having an outer paper shell or cup and aluminum liner with different lids.

FIG. 8 illustrates an exploded view of an embodiment of the two-part recyclable cup having an outer paper shell or cup and aluminum liner with different lids. The liner 130*b* of this embodiment is shown with an outwardly projecting top band 136 that is perpendicularly intersected by vertically oriented ridges or standoff elements 133*b*.

As shown in FIGS. 8-12, the thin removable aluminum liner 130*b* may include vertically oriented outwardly projecting standoff elements 133*b* integrated into the tapered sidewall and may further include a top horizontal-oriented band 136 that projects outward from the sidewall of the thin removable aluminum liner and contacts an interior wall of the paper or pulp outer shell. The top horizontal-oriented band is configured with a smooth non-indented wall area to enable the top edge of the thin removable aluminum liner to be rolled or folded. The top horizontal-oriented band may optionally include small or short hot air release air-vent channels, which for example may be implemented as small gaps between the shell, band, and liner, e.g., short vertical channels. The thin removable aluminum liner is configured to mate with the paper or pulp outer shell through surface-to-surface tension or friction or through any type of male or female indentations in the tapered wall or bottom wall of either the thin removable aluminum liner or the paper or pulp outer shell. The thin removable aluminum liner and the paper or pulp outer shell may be configured so they do not stick to one another as they are stacked within themselves for shipping or retail applications. To prevent stacked parts from becoming stuck together, any shape male and/or female indent or low-friction coatings may be incorporated into the tapered or horizontal bottom wall of either part. Also, shown is lip or rolled edge 131*b* on the shell 132*b*, in combination for example with the lip 131*a* on the liner.

Figure 9:
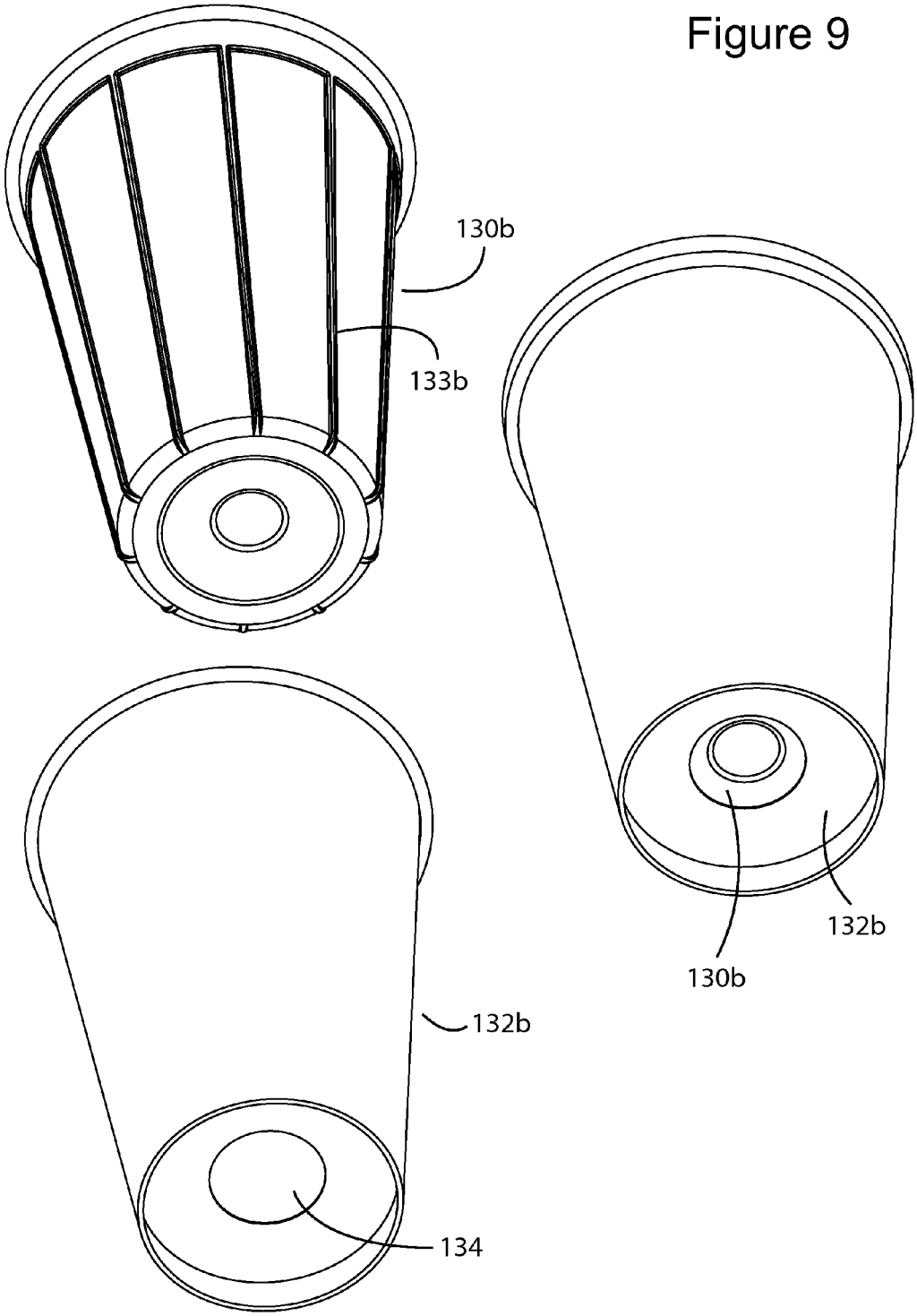
FIG. 9 illustrates a lower perspective view of an embodiment of the two-part recyclable cup having an outer paper shell or cup with a hole through the bottom separate and coupled with an aluminum liner.

FIG. 9 illustrates a lower perspective view of an embodiment of the two-part recyclable cup having an outer paper shell or cup with a hole through the bottom separate and coupled with the aluminum liner wherein the standoff elements 133*b* in this embodiment are in the liner as opposed to the shell as shown in the embodiment of FIG. 2. In one or more embodiments, the liner with standoff elements of FIG. 9 may be utilized with the embodiment of the shell of FIG. 2 so that both components, e.g., the shell and liner include standoff elements and otherwise provide components that separate the shell from the liner. Liner 130*b* of FIG. 9 may be used with a pulp shell that has no standoff elements and smooth interior walls.

Figure 10:
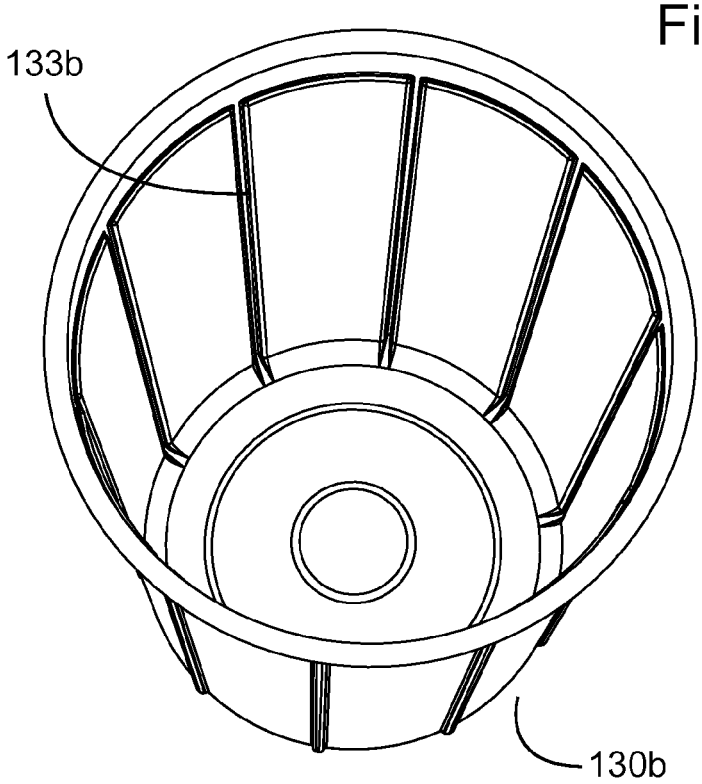
FIG. 10 illustrates an upper perspective view of an embodiment of the two-part recyclable cup with an aluminum liner on the top of the page and paper shell or cup on the bottom of the page.
Figure 10:
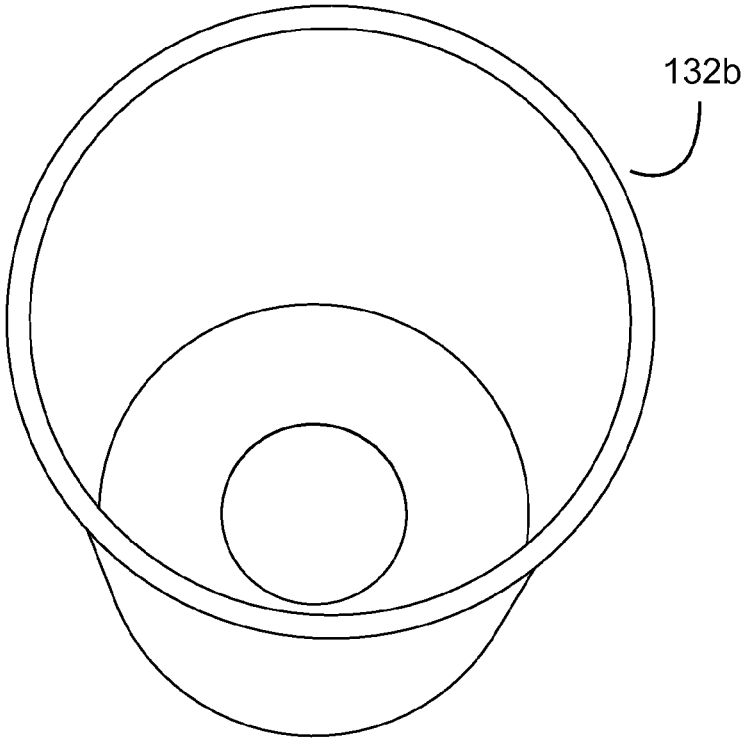

FIG. 10 illustrates an upper perspective view an embodiment of the two-part recyclable cup with aluminum liner 130*b* on the top of the page and paper shell or cup 132*b* on the bottom of the page. As shown, both components may include lips. Alternatively, the paper shell or cup may include a lip while the pulp shell does not in other embodiments.

Figure 11:
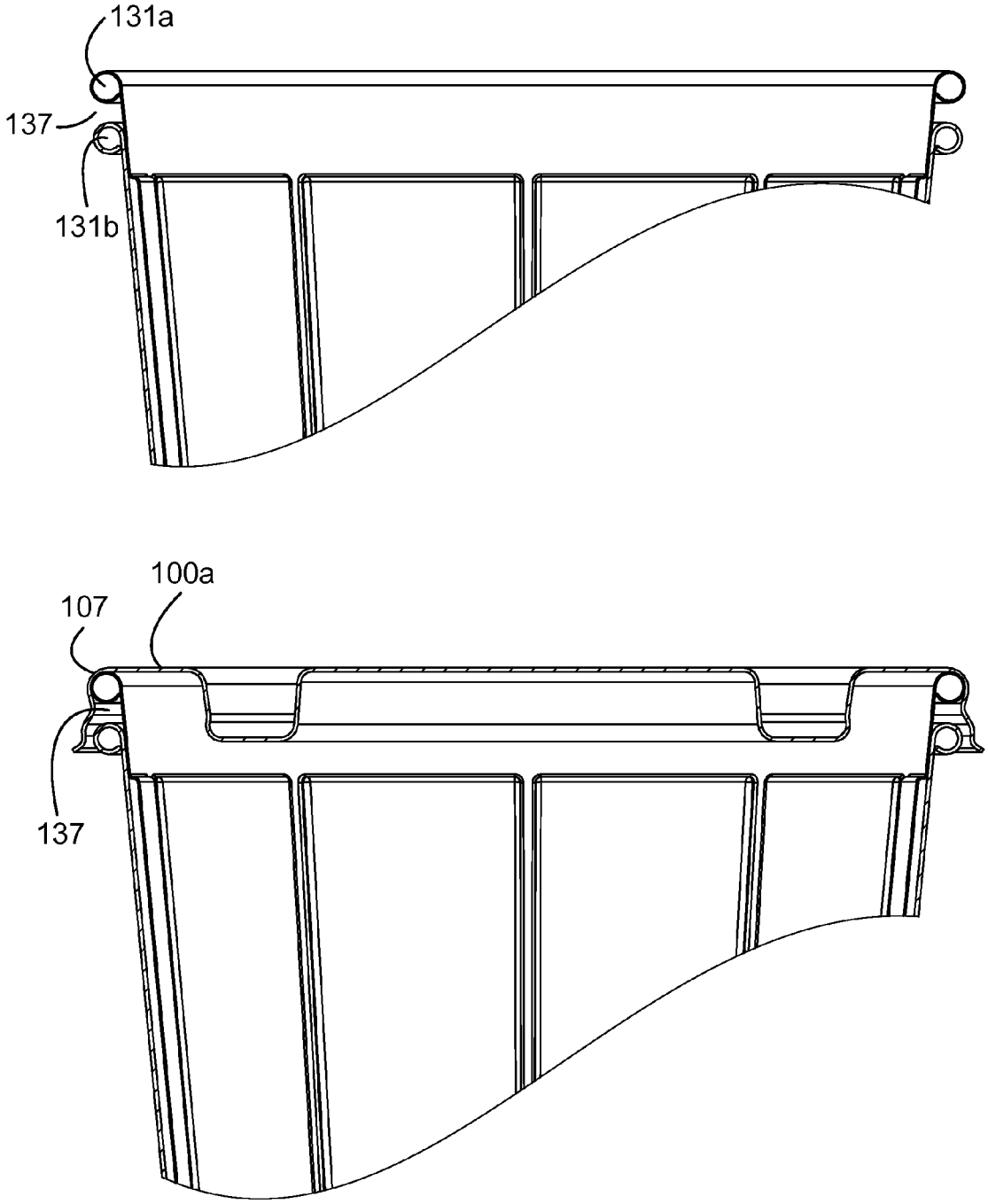
FIG. 11 illustrates a side cutaway view of an embodiment of the two-part recyclable cup having an outer paper shell or cup and aluminum liner with and without a lid coupled therewith.

FIG. 11 illustrates a side cutaway view of an embodiment of the two-part recyclable cup having an outer paper shell or cup and aluminum liner with and without a lid coupled therewith. As shown, gap 137 in this embodiment is formed between lips 131*a* and 131*b*.

Figure 12:
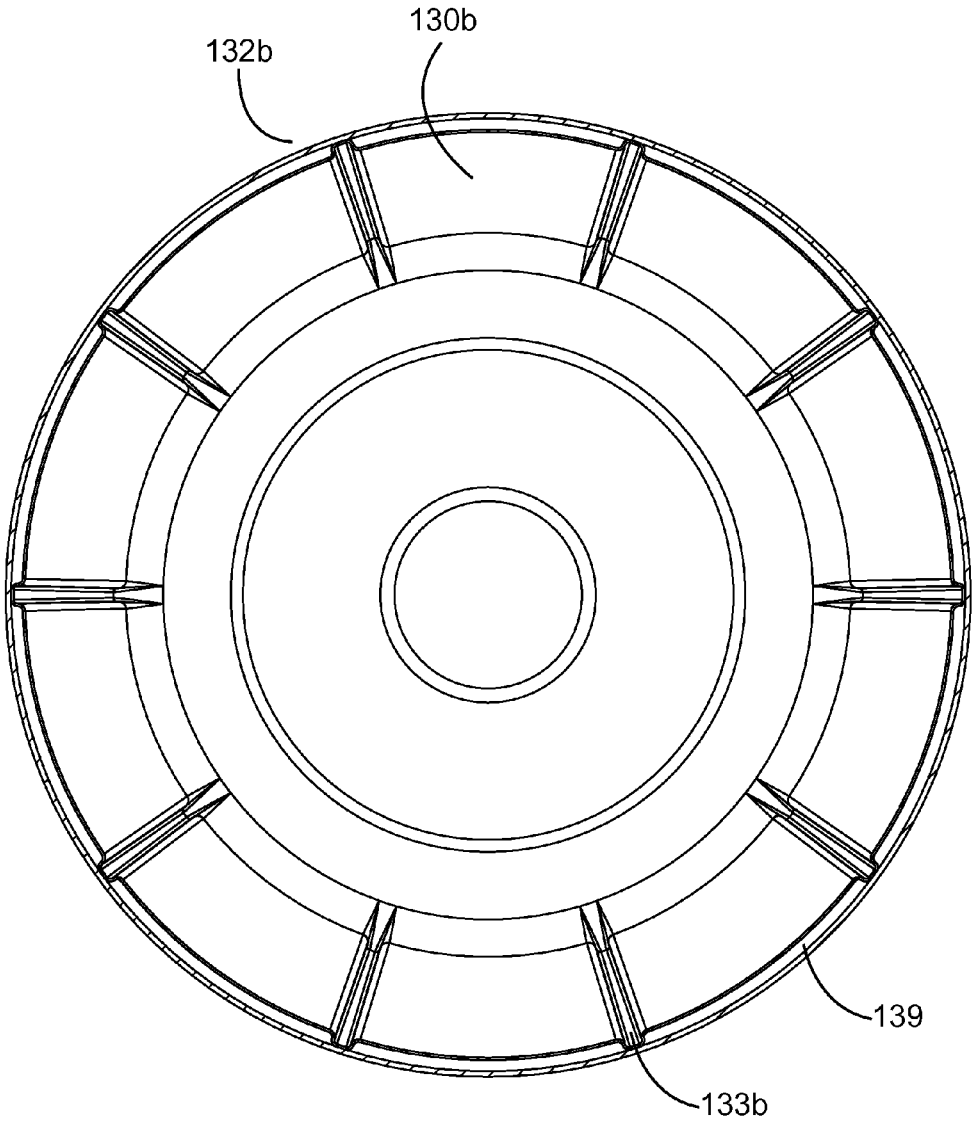
FIG. 12 illustrates a top cutaway view of an embodiment of the two-part recyclable cup having an outer paper shell or cup and aluminum liner.

FIG. 12 illustrates a top cutaway view of an embodiment of the two-part recyclable cup having an outer paper shell or cup and aluminum liner. As shown the standoff elements may be outwardly oriented, for example radially outward oriented towards the shell. In other embodiments, the standoff elements may be alternatively oriented inward or alternate around the shell (and/or liner) in an inward and outward alternating pattern or in any other manner.

While the invention herein disclosed has been described by means of specific embodiments and applications thereof, numerous modifications and variations could be made thereto by those skilled in the art without departing from the scope of the invention set forth in the claims.

What is claimed is:

1. A two-part recyclable cup comprising:

a paper or pulp outer shell;

a thin removable aluminum liner that comprises aluminum, aluminum alloy or aluminum foil;

said thin removable aluminum liner configured to fit within said paper or pulp outer shell;

wherein the paper or pulp outer shell is configured without interior-laminated films or liners and engages with the thin removable aluminum liner that may be disengaged or separated from the paper or pulp outer shell prior to recycling;

wherein the thin removable aluminum liner has an integrated exteriorly located rolled top edge, formed top edge, applied top edge, or folded top edge configured to provide structural stability;

wherein said thin removable aluminum liner or said paper or pulp outer shell comprises a coupling element configured to enable a lid to couple to the top edge of the thin removable aluminum liner or the paper or pulp outer shell;

wherein the thin removable aluminum liner comprises a tapered wall that flares outward toward the top opening of the liner;

wherein the thin removable aluminum liner and the paper or pulp outer shell are configured to stack within themselves or each other to conserve space during shipping;

wherein the thin removable aluminum liner comprises an upward-oriented dome-shaped indentation in a bottom horizontal wall for structural stability, and comprises an additional or independent upward dome-shaped indentation in a bottom horizontal wall that acts as a receptacle configured to enable a user' fingertip to push upward while popping out the thin removable aluminum liner.

2. The two-part recyclable cup of claim 1, wherein the paper or pulp outer shell comprises a hole through the bottom horizontal wall that is configured to enable the user to pop out the thin removable aluminum liner by pushing upward with the fingertip through the hole and wherein said hole is configured to act as a pressure release opening to prevent air pressure or air suction from forming during the process of inserting or removing the thin removable aluminum liner from the paper or pulp outer shell.

3. The two-part recyclable cup of claim 1, wherein the paper or pulp outer shell comprises a rolled top edge, formed top edge, or folded top edge.

4. The two-part recyclable cup of claim 1, wherein the thin removable aluminum liner is painted, coated, or printed on an interior or exterior of the thin removable aluminum liner.

5. The two-part recyclable cup of claim 1, wherein a sidewall of the thin removable aluminum liner comprises an inward or outward vertical or horizontal-oriented strength ribs or indentations or horizontal collapsible-oriented indentations of any shape.

6. The two-part recyclable cup of claim 1, wherein sidewalls of either the thin removable aluminum liner or paper or pulp outer shell may comprise one or more outward or inward-oriented horizontal or vertical standoff elements, ridges, or bands that are configured to provide air pocket gaps between the thin removable aluminum liner and paper or pulp outer shell such that the exterior surface of the paper or pulp outer shell does not get hot and stays cool to a touch of the hand.

7. The two-part recyclable cup of claim 1, wherein a sidewall of the thin removable aluminum liner may be smooth and have no indentations.

8. The two-part recyclable cup of claim 2, wherein the thin removable aluminum liner is configured to be turned upside down, placed on the ground, and crushed with a downward stomp of a foot.

9. The two-part recyclable cup of claim 8, wherein the hole in a bottom horizontal wall of the paper or pulp outer shell is configured to act a pressure-release opening when the shell is crushed with the downward stomp of a foot.

10. The two-part recyclable cup of claim 1, further comprising a lid configured to couple with the two-part recyclable cup wherein the lid is configured to couple to the rolled top edge of the thin removable aluminum liner.

11. The two-part recyclable cup of claim 1, further comprising a separate top food container and attached clamshell style lid, seal-on/peel-off lid, or non-attached press-on lid that are configured to couple to the lid that is configured to couple to a rim of the thin removable aluminum liner or paper or pulp outer shell.

12. The two-part recyclable cup of claim 1, further comprising a lid that couples to a rim of the thin removable aluminum liner or paper or pulp shell that comprises a downward oriented food or liquid cavity and wherein said cavity is configured to be covered by a secondary attachable lid comprising a seal-on/peel-off lid or press-on lid that covers a food or liquid item.

13. The two-part recyclable cup of claim 1, wherein an outside diameter edge of the upward-oriented dome-shaped finger receptacle indentation in the bottom horizontal wall of the thin removable aluminum liner projects downward through the hole in the bottom horizontal wall of the paper or pulp outer shell to engage or interlock the two components.

14. The two-part recyclable cup of claim 1, further comprising a gap or space between the integrated exteriorly located rolled top edge of the thin removable aluminum liner and top edge of the paper or pulp outer shell which is provided to grip and remove the liner and wherein the gap or space is determined by the height of the sidewalls of the thin removable aluminum liner.

15. The two-part recyclable cup of claim 1, wherein the paper or pulp outer shell comprises a thickness, one or more of multiple walls, layers, materials, or water-based adhesives or laminations and includes a smooth exterior printable layer or surface.

16. The two-part recyclable cup of claim 1, wherein the thin removable aluminum liner comprises outwardly projecting vertically oriented standoff elements integrated into the tapered sidewall and further comprises a top horizontal-oriented band proximal to a top rim that projects outward from the sidewall of the thin removable aluminum liner and contacts an interior wall of the paper or pulp outer shell and wherein said top horizontal-oriented band is perpendicularly intersected by said vertically oriented standoff elements or ribs that are located along the thin removable aluminum liner and proceed to the bottom edge thereof and wherein said top horizontal-oriented band is configured to provide a smooth non-indented wall area configured to enable said top edge of the thin removable aluminum liner to be rolled or folded and wherein said top horizontal-oriented band comprises hot air release air-vent channels.

17. The two-part recyclable cup of claim 1, wherein the thin removable aluminum liner is configured to mate with the paper or pulp outer shell through surface-to-surface tension or friction or through any type of male or female indentations in the tapered wall or bottom wall of either the thin removable aluminum liner or the paper or pulp outer shell.

18. The two-part recyclable cup of claim 1, wherein the thin removable aluminum liner and the paper or pulp outer shell are configured to prevent sticking to one another as they are stacked within themselves.

19. A two-part recyclable cup comprising:

a paper or pulp outer shell;

a thin removable aluminum liner that comprises aluminum, aluminum alloy or aluminum foil;

said thin removable aluminum liner configured to fit within said paper or pulp outer shell;

wherein the paper or pulp outer shell is configured without interior-laminated films or liners and engages with the thin removable aluminum liner that may be disengaged or separated from the paper or pulp outer shell prior to recycling;

wherein the thin removable aluminum liner has an integrated exteriorly located rolled top edge, formed top edge, applied top edge, or folded top edge configured to provide structural stability;

a gap or space between the integrated exteriorly located rolled top edge of the thin removable aluminum liner and top edge of the paper or pulp outer shell which is provided to grip and remove the liner and wherein the gap or space is determined by a height of sidewalls of the thin removable aluminum liner;

wherein said thin removable aluminum liner or said paper or pulp outer shell comprises a coupling element configured to enable a lid to couple to the top edge of the thin removable aluminum liner or the paper or pulp outer shell;

wherein the thin removable aluminum liner comprises a tapered wall that flares outward toward the top opening of the liner;

wherein the thin removable aluminum liner and the paper or pulp outer shell are configured to stack within themselves or each other to conserve space during shipping;

wherein the thin removable aluminum liner comprises an upward-oriented dome-shaped indentation in a bottom horizontal wall for structural stability, and comprises an additional or independent upward dome-shaped indentation in a bottom horizontal wall that acts as a receptacle configured to enable a user' fingertip to push upward while popping out the thin removable aluminum liner; and wherein an outside diameter edge of the upward-oriented dome-shaped finger receptacle indentation in the bottom horizontal wall of the thin removable aluminum liner projects downward through the hole in the bottom horizontal wall of the paper or pulp outer shell to engage or interlock the two components.

20. A two-part recyclable cup comprising:

a paper or pulp outer shell;

a thin removable aluminum liner that comprises aluminum, aluminum alloy or aluminum foil;

said thin removable aluminum liner configured to fit within said paper or pulp outer shell;

wherein the paper or pulp outer shell is configured without interior-laminated films or liners and engages with the thin removable aluminum liner that may be disengaged or separated from the paper or pulp outer shell prior to recycling;

wherein the thin removable aluminum liner has an integrated exteriorly located rolled top edge, formed top edge, applied top edge, or folded top edge configured to provide structural stability;

a gap or space between the integrated exteriorly located rolled top edge of the thin removable aluminum liner and top edge of the paper or pulp outer shell which is provided to grip and remove the liner and wherein the gap or space is determined by a height of sidewalls of the thin removable aluminum liner;

wherein said thin removable aluminum liner or said paper or pulp outer shell comprises a coupling element configured to enable a lid to couple to the top edge of the thin removable aluminum liner or the paper or pulp outer shell;

wherein the thin removable aluminum liner comprises a tapered wall that flares outward toward the top opening of the liner;

wherein the thin removable aluminum liner and the paper or pulp outer shell are configured to stack within themselves or each other to conserve space during shipping; and, shipping;

wherein the paper or pulp outer shell comprises a hole through the bottom horizontal wall that is configured to enable a user to pop out the thin removable aluminum liner by pushing upward with a fingertip through the hole and wherein said hole is configured to act as a pressure release opening to prevent air pressure or air suction from forming during the process of inserting or removing the thin removable aluminum liner from the paper or pulp outer shell;

wherein the thin removable aluminum liner comprises an upward-oriented dome-shaped indentation in a bottom horizontal wall for structural stability, and comprises an additional or independent upward dome-shaped indentation in a bottom horizontal wall that acts as a receptacle configured to enable the user' fingertip to push upward while popping out the thin removable aluminum liner; and wherein an outside diameter edge of the upward-oriented dome-shaped finger receptacle indentation in the bottom horizontal wall of the thin removable aluminum liner projects downward through the hole in the bottom horizontal wall of the paper or pulp outer shell to engage or interlock the two components.

* * * * *